US012351415B2

(12) United States Patent
Dahill et al.

(10) Patent No.: US 12,351,415 B2
(45) Date of Patent: Jul. 8, 2025

(54) TAPE APPLICATOR

(71) Applicant: TECHTRONIC CORDLESS GP, Anderson, SC (US)

(72) Inventors: Drew A. Dahill, Pendleton, SC (US); Ryan A. Hirtz, Pelzer, SC (US); Robert J. Lee, Simpsonville, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 17/931,811

(22) Filed: Sep. 13, 2022

(65) Prior Publication Data

US 2024/0083706 A1 Mar. 14, 2024

(51) Int. Cl.
*B65H 35/00* (2006.01)

(52) U.S. Cl.
CPC ..... *B65H 35/0033* (2013.01); *B65H 35/0073* (2013.01); *B65H 2701/377* (2013.01)

(58) Field of Classification Search
CPC ..... B65H 75/2281; B65H 75/2272; B65H 75/2227; B65H 75/2245; B65H 75/2218; B65H 75/2209; B65H 75/22; B65H 75/249; B65H 75/229
See application file for complete search history.

(56) References Cited

U.S. PATENT DOCUMENTS 2,759,545 A * 8/1956 Rizza ..... B65H 35/008 225/45
2,790,609 A 4/1957 Hawthorne et al.
3,505,153 A 4/1970 Addis
3,745,086 A 7/1973 Parker
3,871,940 A * 3/1975 Antonioni ..... B05C 9/10 156/577
4,101,095 A * 7/1978 Carter ..... B65H 75/2281 242/608.5
4,805,869 A 2/1989 Saunders et al.
4,884,734 A 12/1989 Kahl, Jr. et al.
5,065,925 A 11/1991 Ridenour
5,269,871 A 12/1993 Longworth et al.
5,294,068 A 3/1994 Baro et al.
5,351,869 A 10/1994 Ridenour
5,456,422 A 10/1995 Longworth
(Continued)

FOREIGN PATENT DOCUMENTS

CH 697162 A5 5/2008
CN 107500012 A 12/2017
(Continued)

OTHER PUBLICATIONS

Extended European Search Report for Application No. 23193814.3 dated Feb. 9, 2024 (9 pages).

*Primary Examiner* — Alex B Efta
(74) *Attorney, Agent, or Firm* — Michael Best & Friedrich LLP

(57) ABSTRACT

A tape applicator including a housing and an adjustment mechanism. The housing partially defines a cavity. The adjustment mechanism includes a course and an adjustment plate. The course includes a plurality of positions. The adjustment plate is movable along the course among the plurality of positions. The adjustment plate is held in a selected position of the plurality of positions by the housing based on a size of a tape roll configured to be supported in the cavity.

9 Claims, 14 Drawing Sheets

(56) References Cited

U.S. PATENT DOCUMENTS

| | | | | |
|---|---|---|---|---|
| D399,257 | S | 10/1998 | Tang et al. | |
| 6,145,722 | A | 11/2000 | Behrens et al. | |
| 6,742,562 | B2 | 6/2004 | Pitzen | |
| 6,926,059 | B2 | 8/2005 | Somers et al. | |
| 7,077,184 | B2 | 7/2006 | Mertins, Jr. et al. | |
| 7,096,915 | B2 | 8/2006 | Yu Chen | |
| 7,441,581 | B2 | 10/2008 | Pitzen | |
| 8,037,919 | B2 | 10/2011 | Yu Chen | |
| 10,046,937 | B2 | 8/2018 | Davidson | |
| 10,294,061 | B1 | 5/2019 | Renkert et al. | |
| 10,875,732 | B2 | 12/2020 | Renkert et al. | |
| 11,247,865 | B1 | 2/2022 | Ellis | |
| 2004/0084496 | A1 | 5/2004 | Yu Chen | |
| 2007/0017951 | A1 | 1/2007 | Martin | |
| 2009/0272497 | A1 | 11/2009 | Pyles | |
| 2011/0042504 | A1* | 2/2011 | Yu Chen ..... | B65H 75/2416 242/578.2 |
| 2015/0232297 | A1 | 8/2015 | Kai et al. | |
| 2022/0127100 | A1 | 4/2022 | Ellis | |
| 2022/0185611 | A1 | 6/2022 | Jang et al. | |

FOREIGN PATENT DOCUMENTS

| | | | |
|---|---|---|---|
| DE | 1761405 | B1 | 5/1972 |
| DE | 8700863 | U1 | 5/1988 |
| DE | 8911613 | U1 | 11/1989 |
| DE | 102005040606 | B4 | 4/2007 |
| FR | 2218205 | A1 | 9/1974 |
| GB | 1189956 | A | 4/1970 |
| WO | 9954245 | A1 | 10/1999 |

* cited by examiner

TAPE APPLICATOR

FIELD

The present disclosure relates to tape applicators, and more specifically, tape applicators for painting applications.

SUMMARY

In one aspect, the disclosure provides a tape applicator including a housing and an adjustment mechanism. The housing partially defines a cavity. The adjustment mechanism includes a course and an adjustment plate. The course includes a plurality of positions. The adjustment plate is movable along the course among the plurality of positions. The adjustment plate is held in a selected position of the plurality of positions by the housing based on a size of a tape roll configured to be supported in the cavity.

In another aspect, the disclosure provides a tape applicator including a housing and an adjustment plate. The housing includes a first housing part and a second housing part. The first housing part defines a tape hub having a stepped rail. The stepped rail includes a first tooth and a second tooth. The second housing part is pivotably coupled to the first housing part and movable between a closed position forming a closed housing with the first housing part and an open position to permit access to an interior of the housing. The adjustment plate disposed between the first housing part and the second housing part. The adjustment plate includes a tab actuatable to selectively engage one of the first tooth and the second tooth when the second housing part of the housing is in the open position.

In yet another aspect, the disclosure provides a tape applicator including a housing and an adjustment plate. The housing defines a cavity with a tape hub and a volume. The housing includes an internal wall. The adjustment plate is mountable to the tape hub such that the volume of the cavity is defined between the internal wall and the adjustment plate. The adjustment plate is movable along the tape hub to selectively change the volume of the cavity based on a size of a tape roll configured to be supported in the cavity.

DETAILED DESCRIPTION

Figure 1:
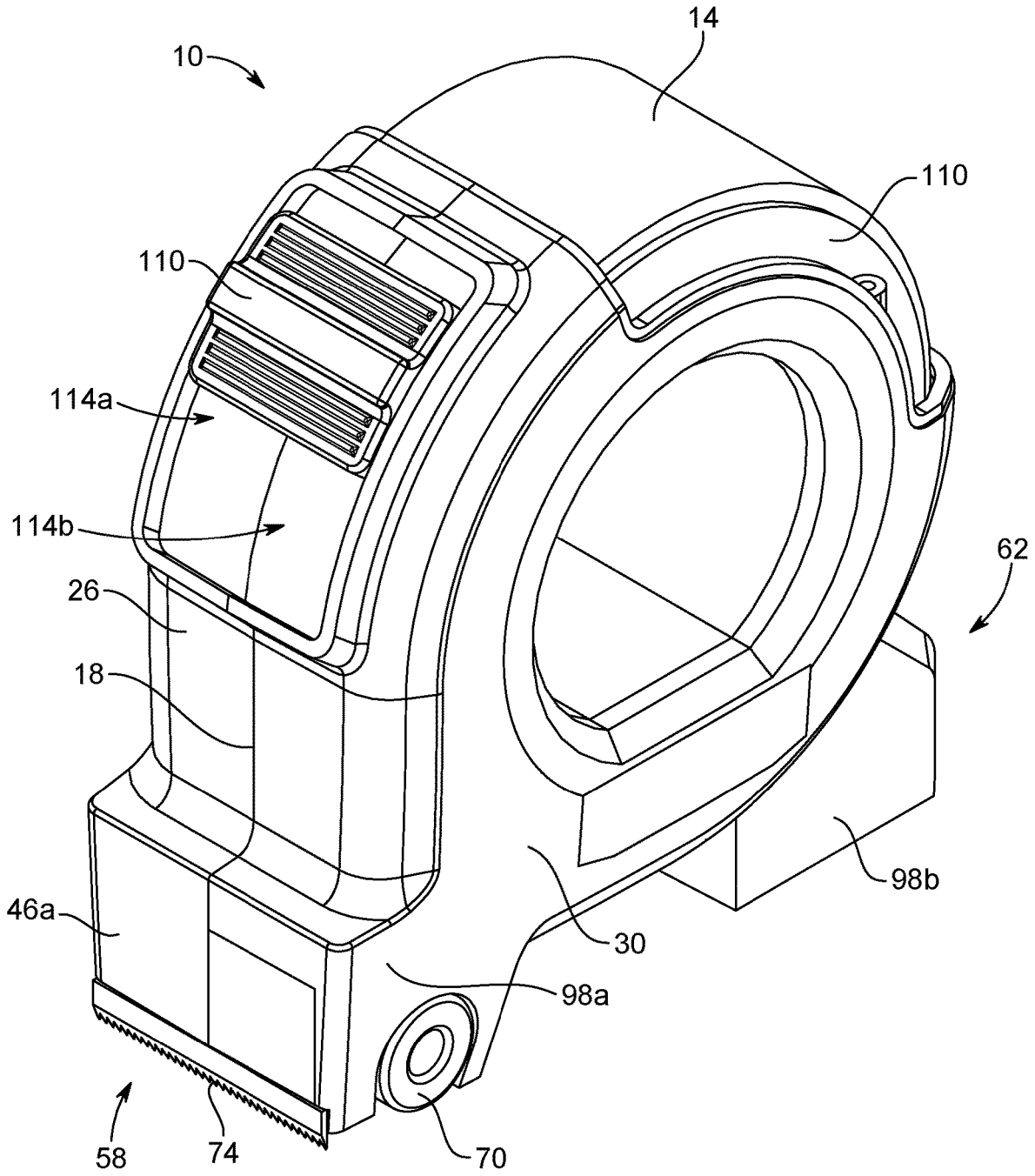
FIG. 1 is a perspective view of a tape applicator in a closed position and including a first tape roll loaded in the tape applicator according to an embodiment of the disclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

The detailed description uses numerical and letter designations to refer to features in the drawings. Like or similar designations in the drawings and description have been used to refer to like or similar parts of the invention.

The singular forms "a," "an," and "the" include plural references unless the context clearly dictates otherwise. The terms "coupled," "fixed," and the like refer to both direct coupling or fixing, as well as indirect coupling or fixing through one or more intermediate components or features, unless otherwise specified herein. As used herein, the terms "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

FIG. 1 illustrates a tape applicator 10 according to an embodiment of the disclosure that may receive different-sized tape rolls 14 and that may be used to apply tape to a work surface. In one application, the tape applicator 10 may be a painter's tape applicator for use in painting applications. For example, the tape applicator 10 may be used to apply tape to a corner surface between two walls or other objects to inhibit undesired paint application on a surface.

Figure 2:
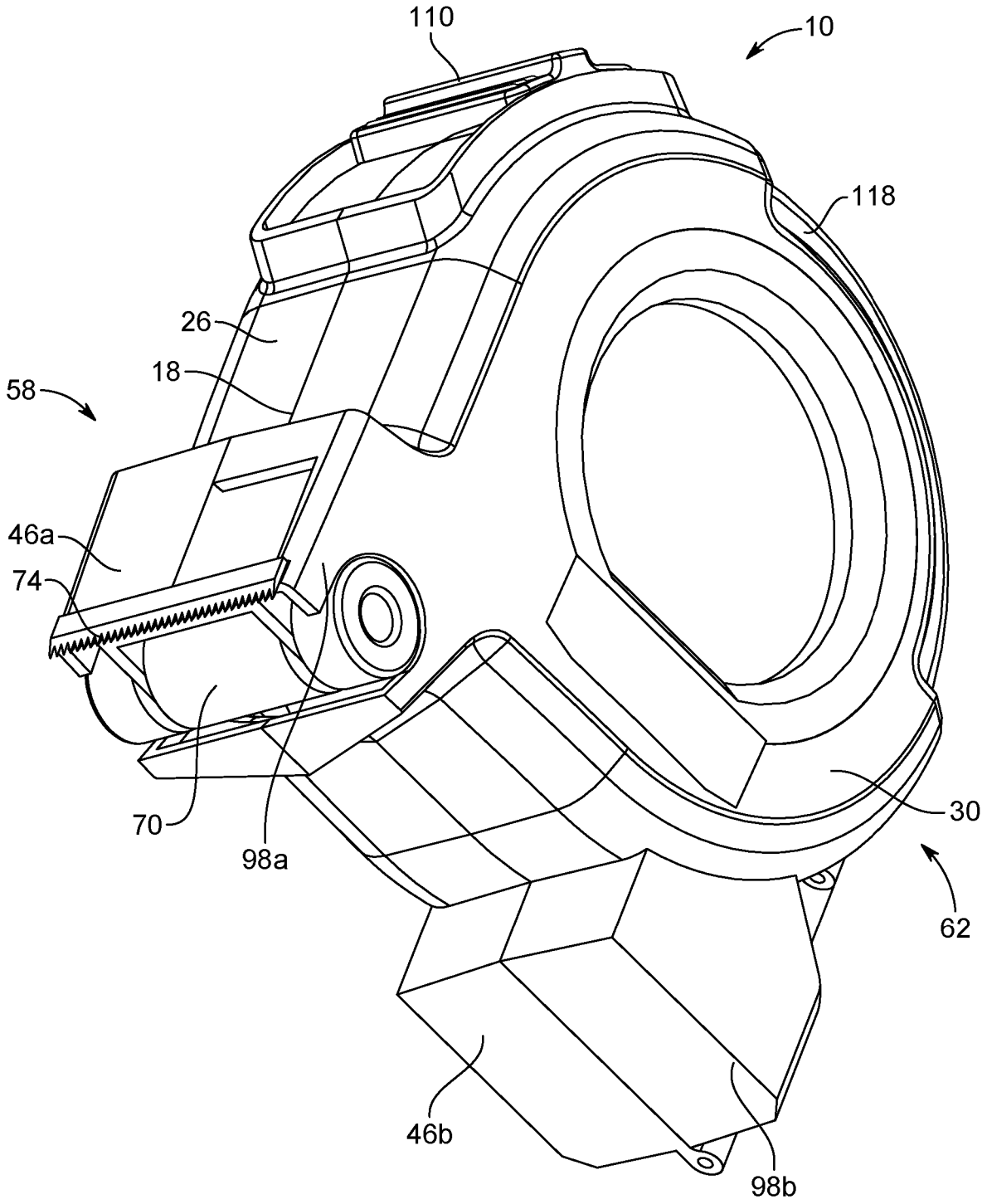
FIG. 2 is another perspective view of the tape applicator and the first tape roll of FIG. 1.
Figure 3:
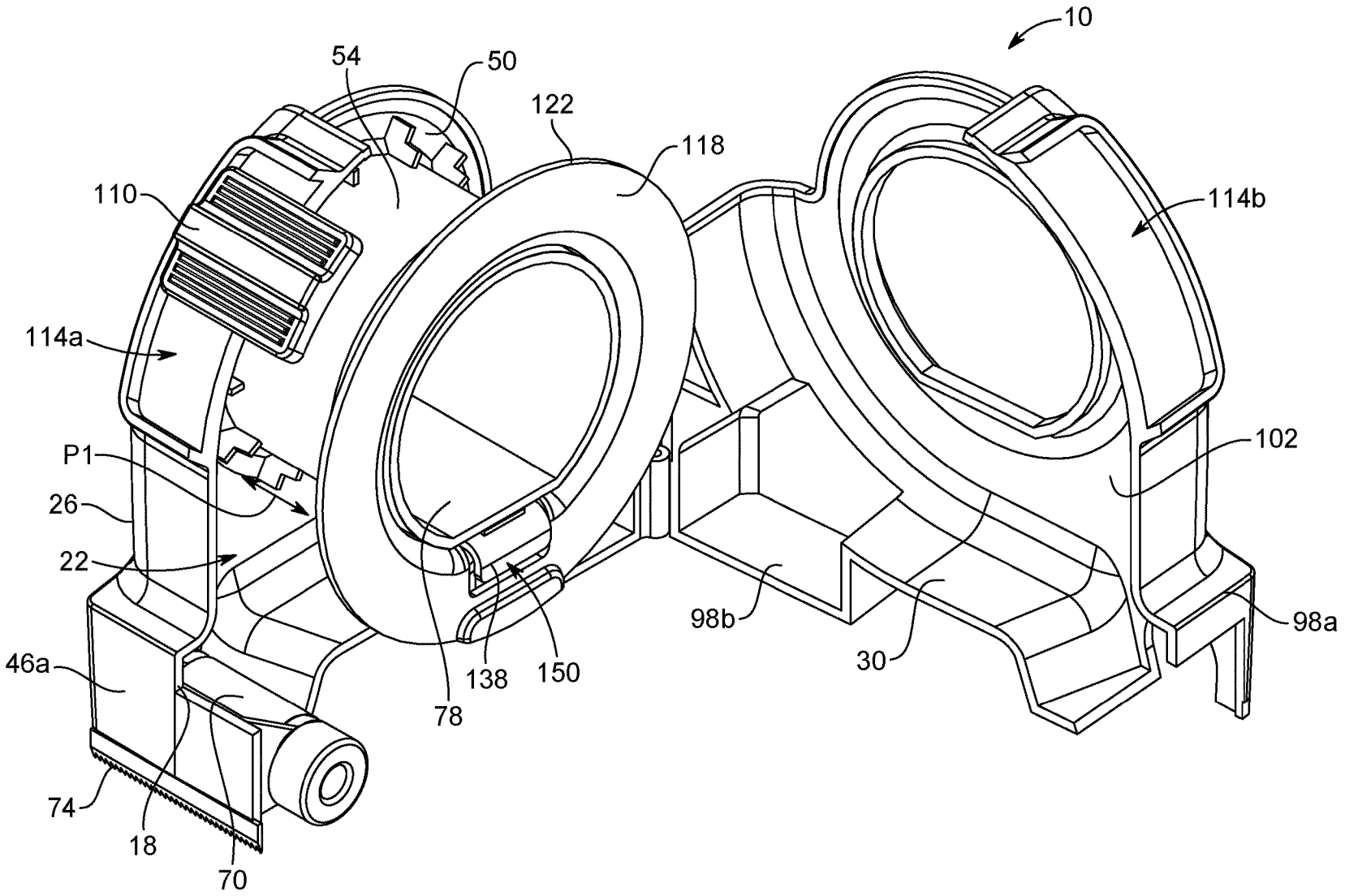
FIG. 3 is a perspective view of the tape applicator of FIG. 1 in an open position.

As illustrated in FIGS. 1-3, the tape applicator 10 includes a housing 18 that at least partially defines a cavity 22 that can support a selected tape roll 14. The housing 18 includes a first housing part 26 and a second housing part 30. The second housing part 30 is rotatably coupled to the first housing part 26 and movable between a closed position and an open position relative to the first housing part 26 of the housing 18.

Figure 4:
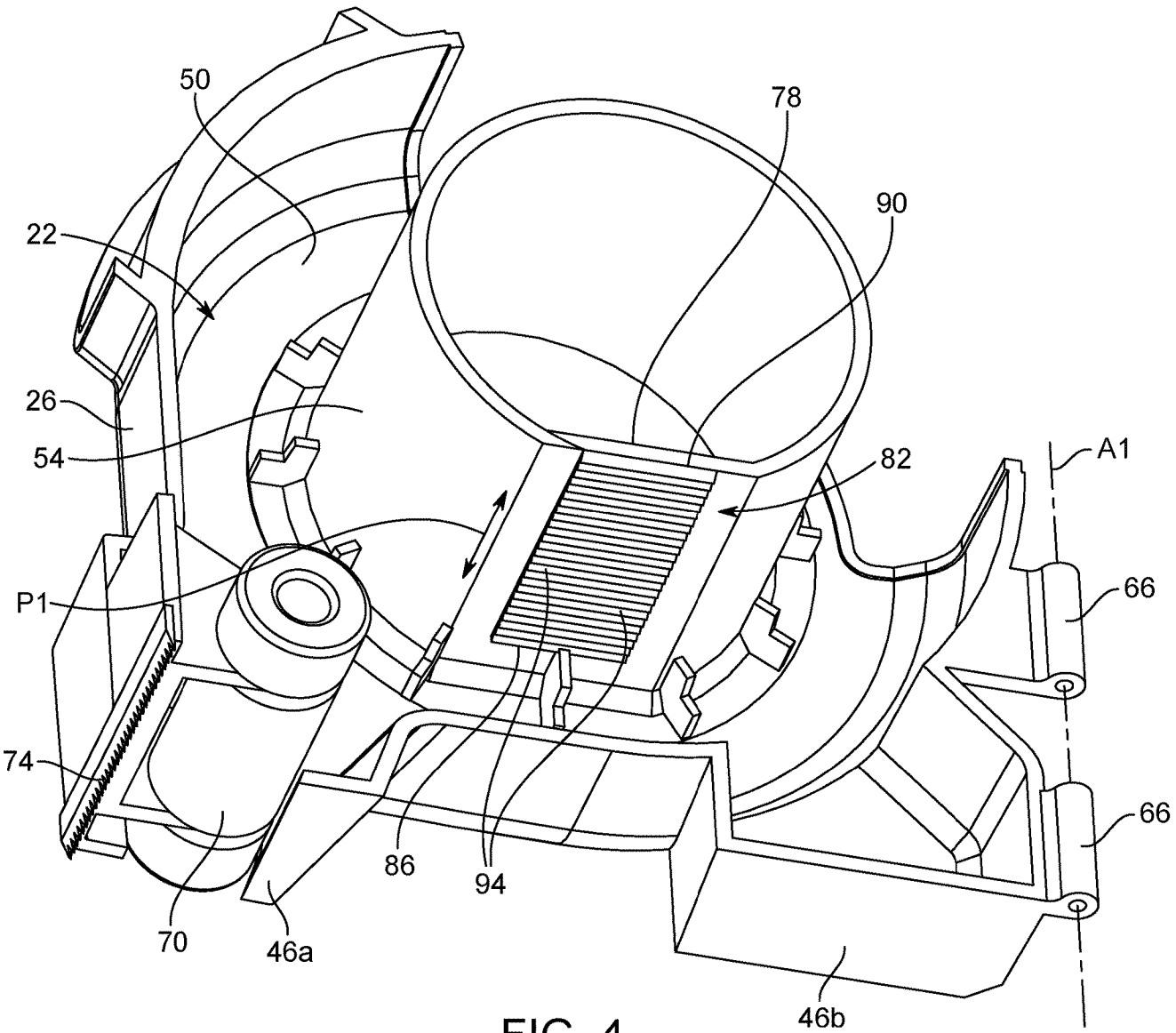
FIG. 4 is a perspective view of a first housing part of the tape applicator of FIG. 1 including a housing and an stepped rail on the housing.

With reference to FIGS. 2 and 3, the first housing part 26 includes a first base leg 46*a* a second base leg 46*b*, a first internal wall 50, and a tape hub 54. The first housing part 26 extends between a first end 58 of the tape applicator 10 and a second end 62 of the tape applicator 10. The first end 58 is a tape applicating end. With reference to FIG. 4, the first base leg 46*a* is located at the first end 58 and the second base leg 46*b* is located at the second end 62. The first housing part 26 also includes first hinged posts 66 at the second end 62, and a support cylinder 70 and a cutting edge 74 that are disposed adjacent the first base leg 46*a* to facilitate tape application. The tape hub 54 extends from the first internal wall 50 and has a first wall section 76 that defines a planar surface 78 and a second wall section 80 that, as shown, is cylindrical or substantially cylindrical. In the illustrated embodiment, the planar surface 78 is located on a side of the tape hub 54 that faces the base legs 46*a*, 46*b* (e.g., the planar surface 78 is located on an underside of the tape hub 54 when viewed as shown in FIG. 4). In other embodiments, the planar surface 78 may be located on a different part of the tape hub 54 (e.g., on the second wall section 80).

Figure 5:
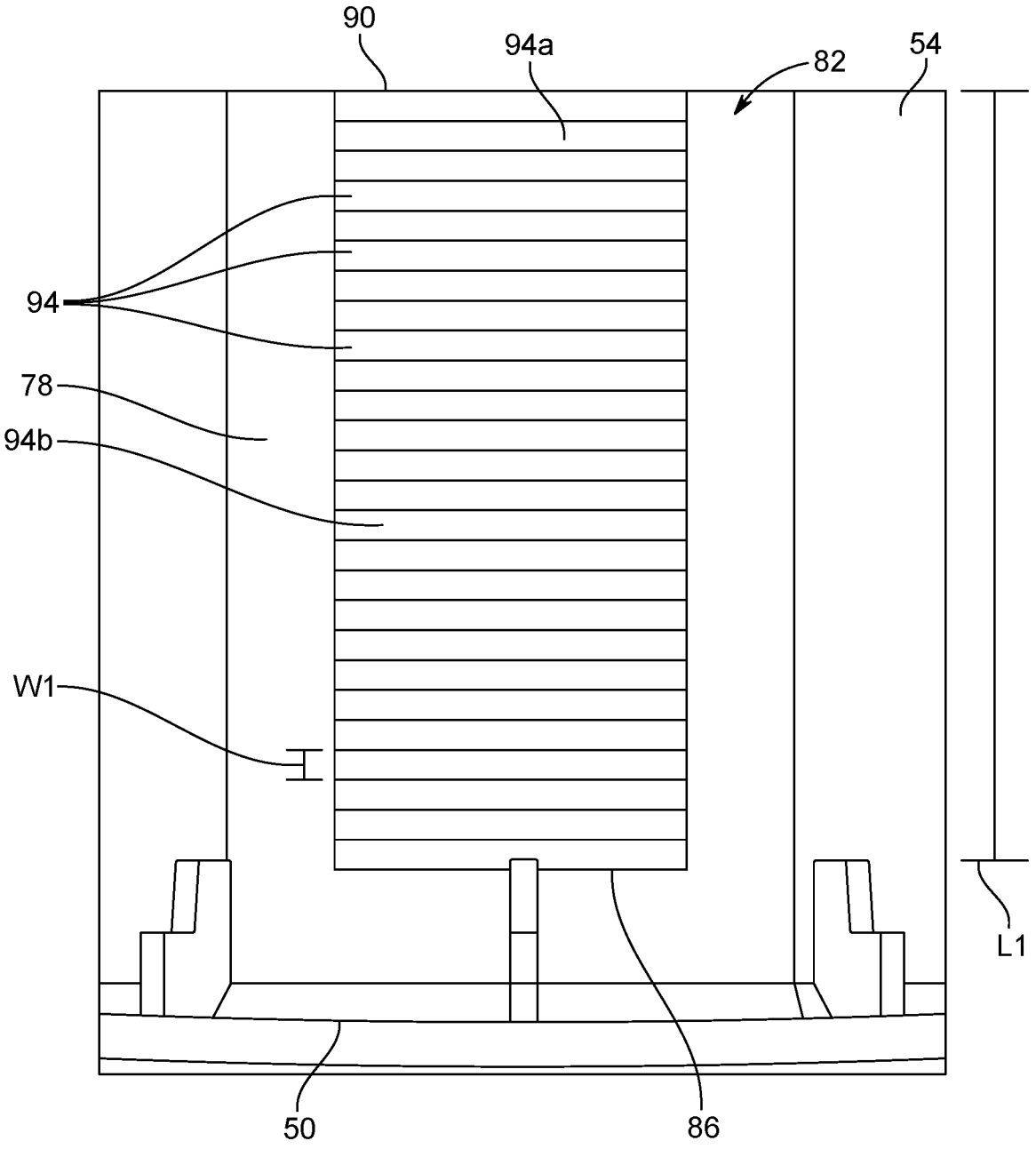
FIG. 5 is a view of the stepped rail of FIG. 4.
Figure 8:
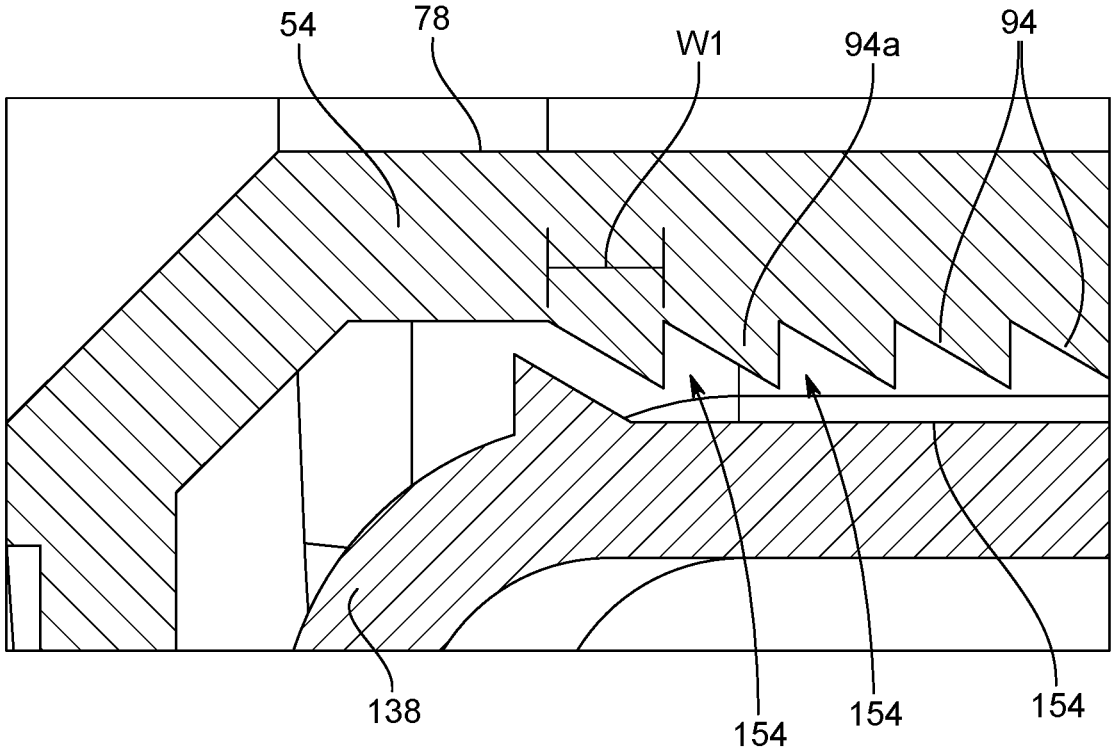
FIG. 8 is a cross-section view illustrating the stepped rail and the adjustment plate.

As illustrated in FIGS. 4 and 5, the tape applicator 10 further includes a stepped rail 82 that is disposed on the housing 18. As best shown in FIG. 4, the stepped rail 82 is disposed on the planar surface 78 and has a first end 86, a second end 90, and a plurality of teeth 94 disposed between the first end 86 and the second end 90. The first end 86 is located between the first internal wall 50 and the second end 90. A length L1 of the stepped rail 82 is defined between the first end 86 and the second end 90. Each of the illustrated teeth 94 is generally triangular, which is best illustrated in FIG. 8, and extends away from the planar surface 78 of the tape hub 54. Each of the teeth 94 includes a width W1 defined along a base of the triangular shape of the teeth 94. As such, the stepped rail 82 includes a quantity of teeth 94 equivalent to the length L1 between the first end 86 and the second end 90 of the stepped rail 82 divided by the width W1 of the teeth 94. In some embodiments, the stepped rail 82 may be located elsewhere on the tape hub 54.

Figure 12:
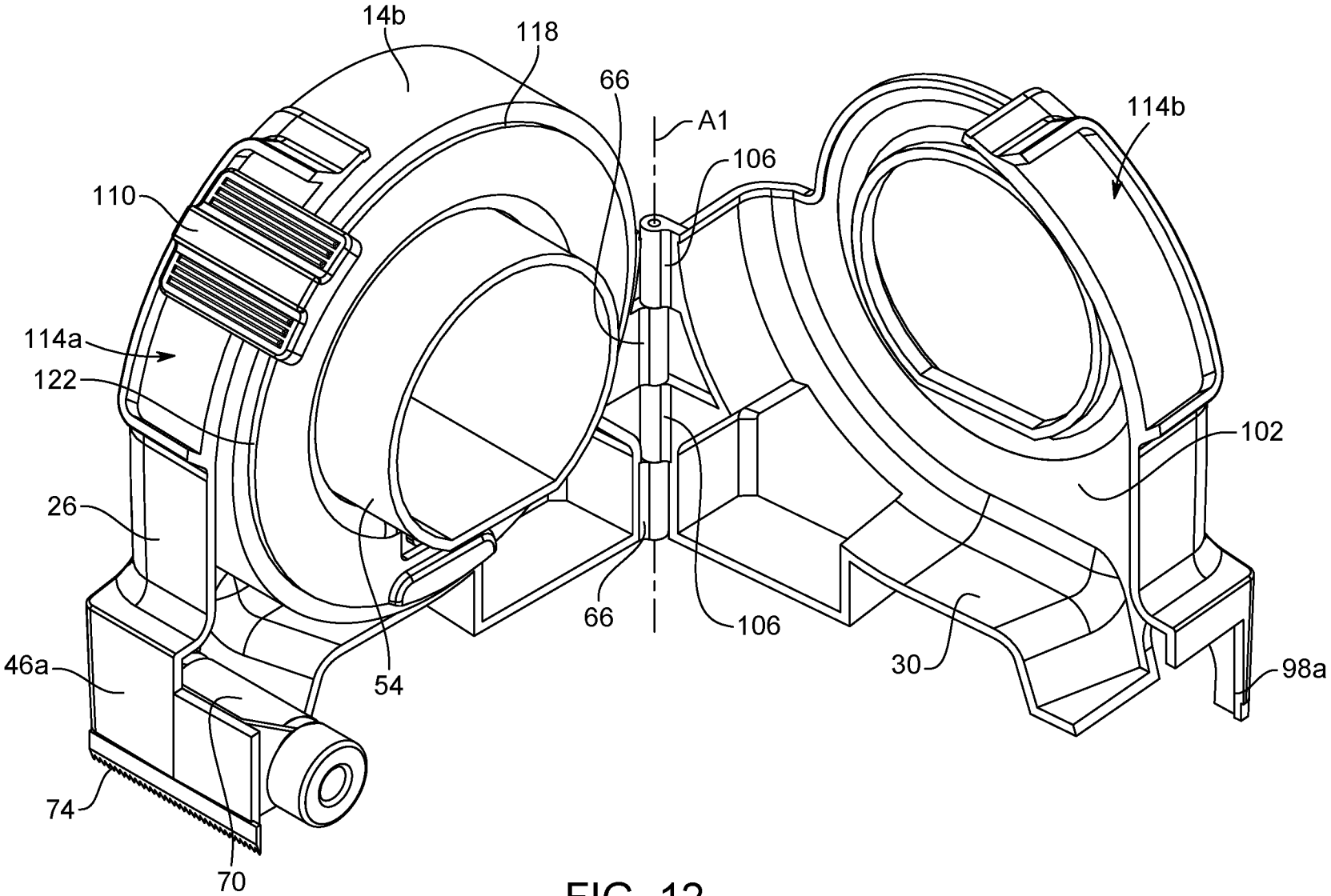
FIG. 12 is a perspective view of the tape applicator in the open position with the second tape roll loaded into the tape applicator.

As shown in FIG. 3, the second housing part 30 includes a third base leg 98*a* disposed at the first end 58, a fourth base leg 98*b* disposed at the second end 62, and a second internal wall 102. The second housing part 30 extends between the first end 58 and the second end 62 of the tape applicator 10. As best illustrated in FIG. 12, the second housing part 30 includes second hinge posts 106 that mate and align with the first hinged posts 66 to define an axis A1 about which the second housing part 30 may pivot or rotate relative to the first housing part 26 between the closed position and the open position. A pin may 108 extend through the first and second hinged posts 66, 106 to hold the posts 66, 106 together. In the closed position, the third base leg 98*a* interfaces with the first base leg 46*a*, the support cylinder 70, and the cutting edge 74, and the fourth base leg 98*b* interfaces with the second base leg 46*b*. In the illustrated embodiment, the first internal wall 50 and the second internal wall 102 are parallel to each other when the second housing part 30 is in the closed position.

The tape applicator 10 further includes an actuator 110 that is positioned on the first housing part 26 and that overlays the second housing part 30 when the second housing part 30 of the tape applicator 10 is in the closed position. The first housing part 26 defines a first portion 114*a* of an actuator slot 114, and the second housing part 30 defines a second portion 114*b* of the actuator slot 114. In the closed position, and as best shown in FIG. 1, the first portion 114*a* and the second portion 114*b* are joined to form the actuator slot 114. The actuator 110 is slidable along the actuator slot 114 lock and unlock the second housing part 30 relative to the first housing part 26 to selectively enable the second housing part 30 to move between the closed position and the open position.

Figure 6:
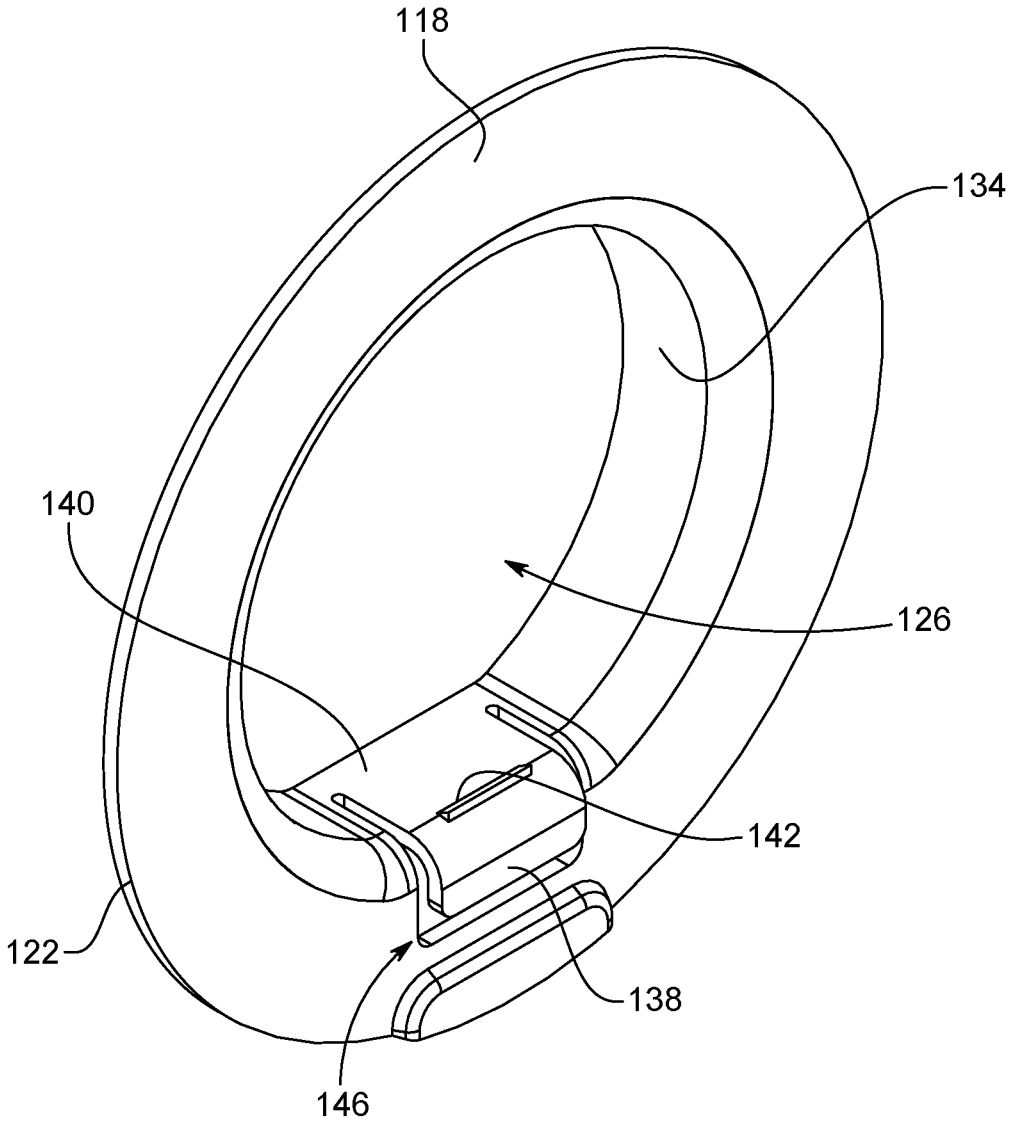
FIG. 6 is a perspective view of an adjustment plate of the tape applicator of FIG. 1.
Figure 7:
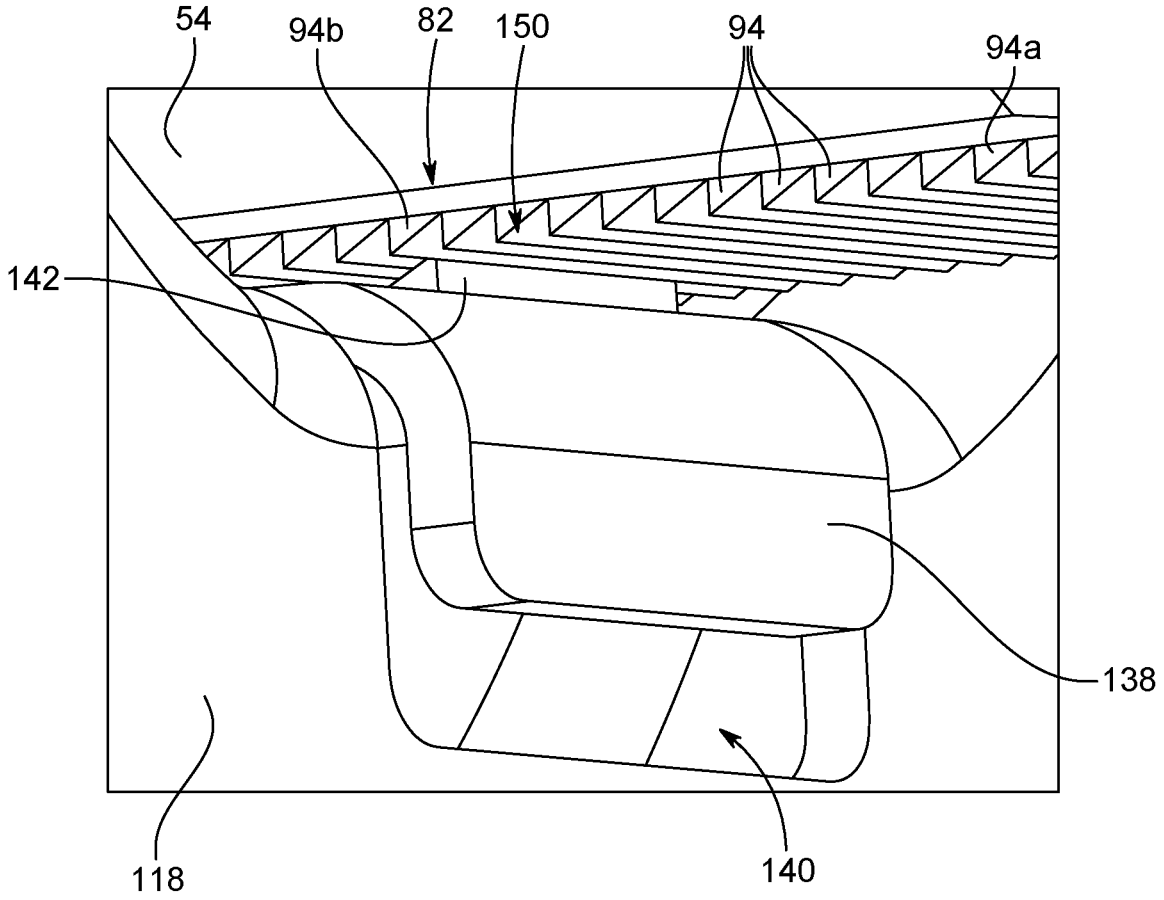
FIG. 7 is an enlarged view of a housing part of the tape applicator illustrating the stepped rail and the adjustment plate.

As illustrated in FIG. 3, the tape applicator 10 includes an adjustment plate 118 that is disposed in the cavity 22 of the housing 18 of the tape applicator 10 and that is attached or mountable to the tape hub 54. The adjustment plate 118 includes a substantially circular profile 122 and, as shown in FIG. 6, a plate aperture 126 that extends through the adjustment plate 118. The plate aperture 126 has the same or substantially the same internal cross-sectional shape or inner periphery 134 as the shape of the outer portion of the tape hub 54 (i.e. the first wall section 76 and the second wall section 80). With continued reference to FIG. 6, a tab 138 extends from a planar section 140 of the adjustment plate 118 adjacent the inner periphery 134. With reference to FIGS. 6-8, the tab 138 extends axially and curves approximately 90 degrees to align with and be spaced from a face of the adjustment plate 118. The tab 138 includes a protrusion or projection 142 that extends into the plate aperture 126 and is substantially triangular (best seen in FIG. 8). The projection 142 has substantially the same cross-section as the each of the teeth 94 of the stepped rail 82 and, as shown in FIG. 7, is inverted relative to the teeth 94 when the tape applicator 10 is assembled. The adjustment plate 118 defines a tab slot 146 adjacent and in line with (and below) the tab 138 to allow a user to actuate or manipulate the tab 138 to disengage the projection 142 from the stepped rail 82. In this context, the tab 138 is coplanar with the planar section 140 absent a force acting on the tab 138 and can be biased out of plane relative to the planar section 140 to disengage the projection 142 from the teeth 94, which allows the adjustment plate 118 to be moved relative to the tape hub 54 and the stepped rail 82. In the illustrated embodiment, the tab 138 is not accessible to a user in the closed position. that is, the tab 138 is covered or enclosed by the second housing part 30 in the closed position.

With reference to FIGS. 4 and 5, the stepped rail 82 defines an adjustment course P1 that has a plurality of plate adjustment positions between the first end 86 and the second end 90 of the stepped rail 82 corresponding to the spacing of the teeth 94. The stepped rail 82 and the adjustment plate 118 cooperate to define an adjustment mechanism 150 of the tape applicator 10 so that the tape applicator 10 can accommodate, or be compatible with, tape rolls 14 that have different widths. The adjustment plate 118 is movable along the adjustment course P1 between the plate adjustment positions and the adjustment plate 118 may be held in a selected position of the plurality positions by the teeth 94. The selected position is based on the size or width of the tape roll 14 that is supported in the cavity 22. When the second housing part 30 is in the open position, the adjustment plate 118 may be adjusted relative to the tape hub 54 to abut a selected tape roll 14, after which the second housing part 30 may be moved to the closed position. When the adjustment plate 118 is engaged with the stepped rail 82, the projection 142 is disposed in a gap 154 between the teeth 94. The gap 154 may have substantially the same cross-section as the projection 142. As shown in FIG. 8, the teeth 94 and the projection 142 are shaped so that the adjustment plate 118 may be moved along the stepped rail 82 toward the first internal wall 50 without depressing the tab 138 (e.g., ratcheted movement). This may provide tactile feedback regarding movement of the adjustment plate 118. The teeth 94 and the projection 142 are further shaped to inhibit outward movement of the adjustment plate 118 relative to the first internal wall 50 absent a force on the tab 138 that bends the projection 142 out of engagement relative to the stepped rail 82. It will be appreciated that the adjustment plate 118 may be adjusted inward relative to the tape hub 54 by pressing the tab 138 until the adjustment plate 118 engages the selected tape roll 14. The tab 138 may then be released to engage the projection 142 with the stepped rail 82.

The volume of the cavity 22 depends on the location of the adjustment plate 118 and may be adjusted by movement of the adjustment plate 118 along the tape hub 54 (inward or outward). More specifically, the cavity 22 has a total volume of which the adjustment plate 118 divides the total volume into a first volume and a second volume. The first volume is defined between the first internal wall 50 and the adjustment plate 118. The second volume is defined between the adjustment plate 118 and the second internal wall 102. The adjustment plate 118 is movable along the tape hub 54 to selectively alter the first volume of the cavity 22 based on a size of the selected tape roll 14 to be supported in the cavity 22.

Figure 9:
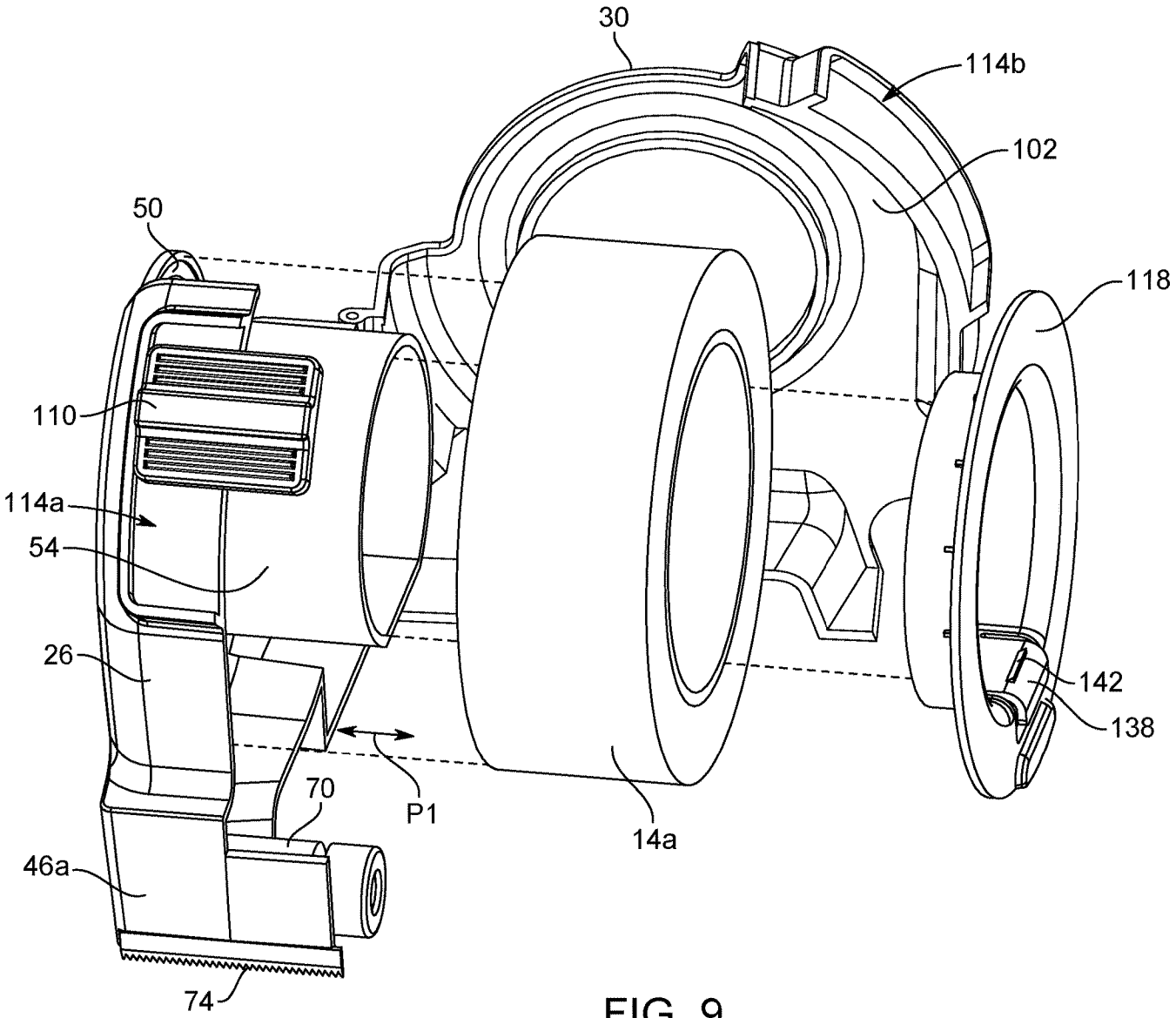
FIG. 9 is a perspective view of the tape applicator in the open position and illustrating the first tape roll being loaded into the tape applicator.
Figure 10:
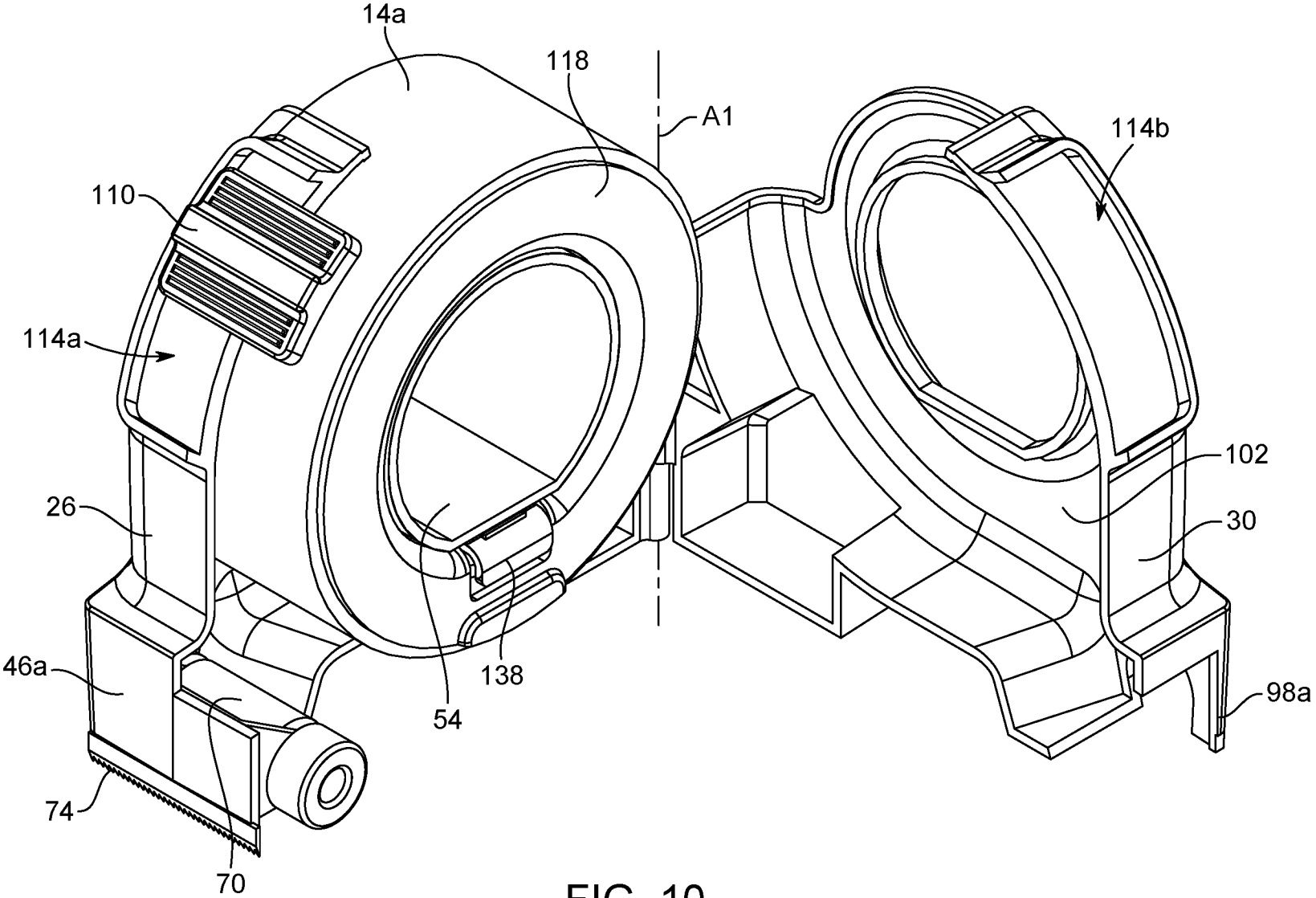
FIG. 10 is a perspective view of the tape applicator in the open position with the first tape roll loaded into the tape applicator.

With reference to FIGS. 9 and 10, the tape applicator 10 may be loaded with the selected tape roll 14 by sliding the actuator 110 along the actuator slot 114 to unlock the second housing part 30 relative to the first housing part 26. With the second housing part 30 unlocked, a user may rotate the second housing part 30 about the axis A1 to the open position. After the second housing part 30 has been opened, a user may actuate or manipulate the tab 138 to disengage the projection 142 from the stepped rail 82 and slide the adjustment plate 118 off the tape hub 54. If a first tape roll 14*a* is already disposed in the tape hub 54, the first tape roll 14*a* is removed and a second tape roll 14*b* may be inserted (e.g., slid) onto the tape hub 54. With the second tape roll 14*b* positioned on the tape hub 54, a user positions the adjustment plate 118 on the tape hub 54 and moves the adjustment plate 118 toward the second tape roll 14*b* until the adjustment plate 118 abuts the second tape roll 14*b*. The projection 142 engages the stepped rail 82 to hold the adjustment plate 118 in place adjacent the first tape roll 14*a*. As such, the second tape roll 14*b* is sandwiched between the first internal wall 50 and the adjustment plate 118 and immovable, or substantially immovable, laterally within the housing 18. The second housing part 30 may then be rotated to the closed position for use.

The tape applicator 10 is advantageously adjustable to accommodate different-sized rolls of tape. Specifically, the projection 142 is engageable with the plurality of teeth 94 of the stepped rail 82 to secure the adjustment plate 118 at a selected position along the stepped rail 82, thereby adjusting the volume of the cavity 22. As such, the selected position enables the adjustment plate 118 to hold different sized rolls of tape against the first internal wall 50. The adjustment plate 118 is adjustable between the first end 86 and the second end 90 of the stepped rail 82 among the plurality of positions along the course P1 based on the quantity of gaps 154 between the teeth 94.

Figure 11:
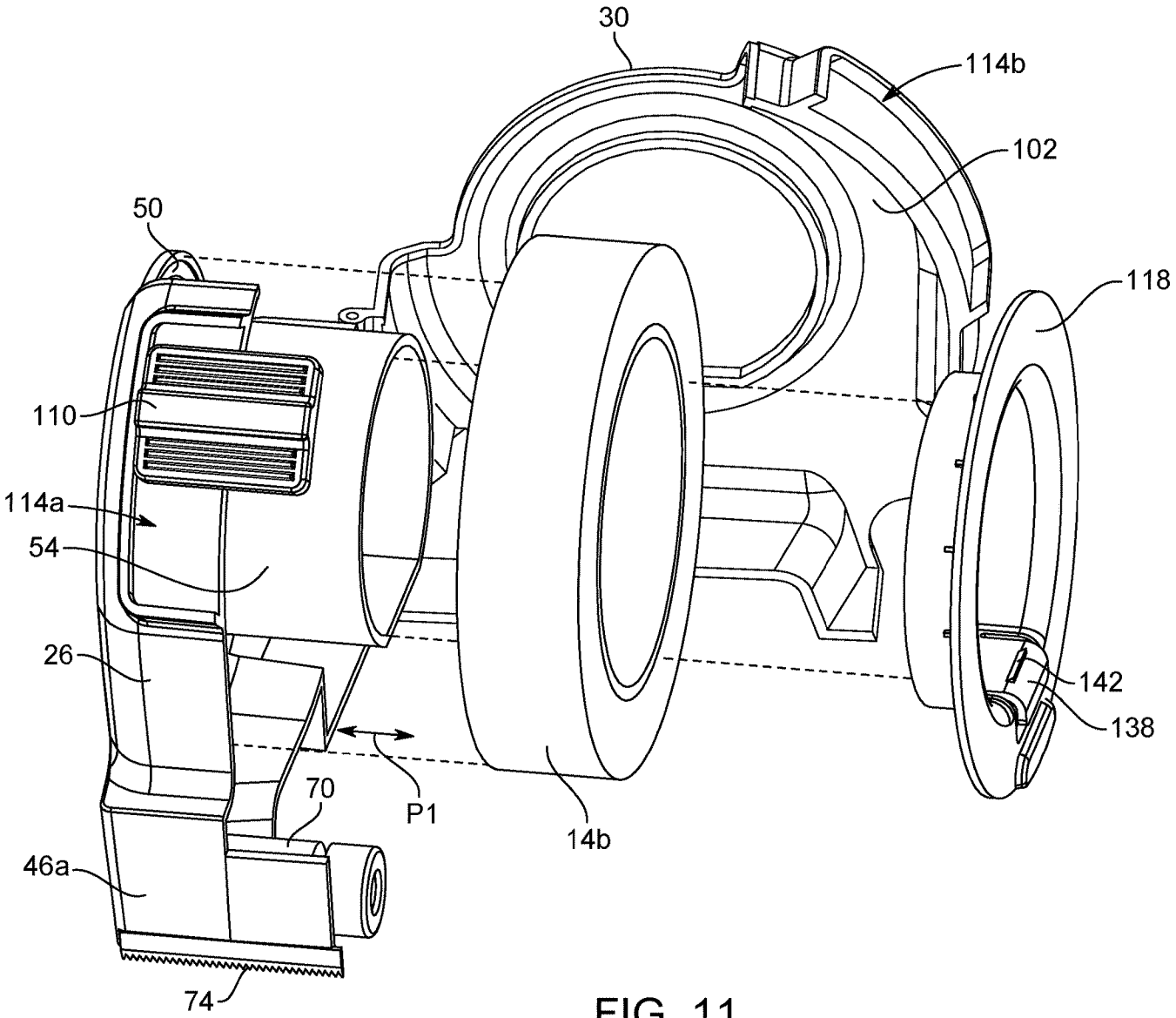
FIG. 11 is a perspective view of the tape applicator in the open position and illustrating loading of a second tape roll into the tape applicator.

With reference to FIG. 9, the tape applicator 10 may be loaded with a different sized tape roll 14. To do so, a user manipulates the tab 138 to disengage the projection 142 from a first tooth 94*a* to allow removal of the adjustment plate 118 from the tape hub 54 as explained above. As illustrated in FIGS. 11 and 12, a user may then insert or position (e.g., slide) a second tape roll 14*b* onto the tape hub 54. The second tape roll 14*b* may be thinner, thicker, or have the same width as the first tape roll 14*a*. In the illustrated embodiment, the second tape roll 14*b* is thinner than the first tape roll 14*a*. With the second tape roll 14*b* positioned on the tape hub 54, a user may then position the adjustment plate 118 on the tape hub 54 adjacent (e.g., abutting) the second tape roll 14*b* to hold the second tape roll 14*b* in the cavity 22. In this position, the projection 142 is engaged with a second tooth 94*b* of the stepped rail 82 that is different from the first tooth 94*a*. Due to the thinner tape roll 14*b*, the second tooth 94*b* is located closer to the first end 86 of the stepped rail 82 than the first tooth 94*a*. With reference to FIG. 12, the second housing part 30 may then be rotated to the closed position. In general, the adjustment plate 118 is engageable with the tape hub 54 to hold different-sized tape rolls 14 in the cavity 22 and to inhibit different-sized tape rolls 14 from moving within the cavity 22.

Figure 13:
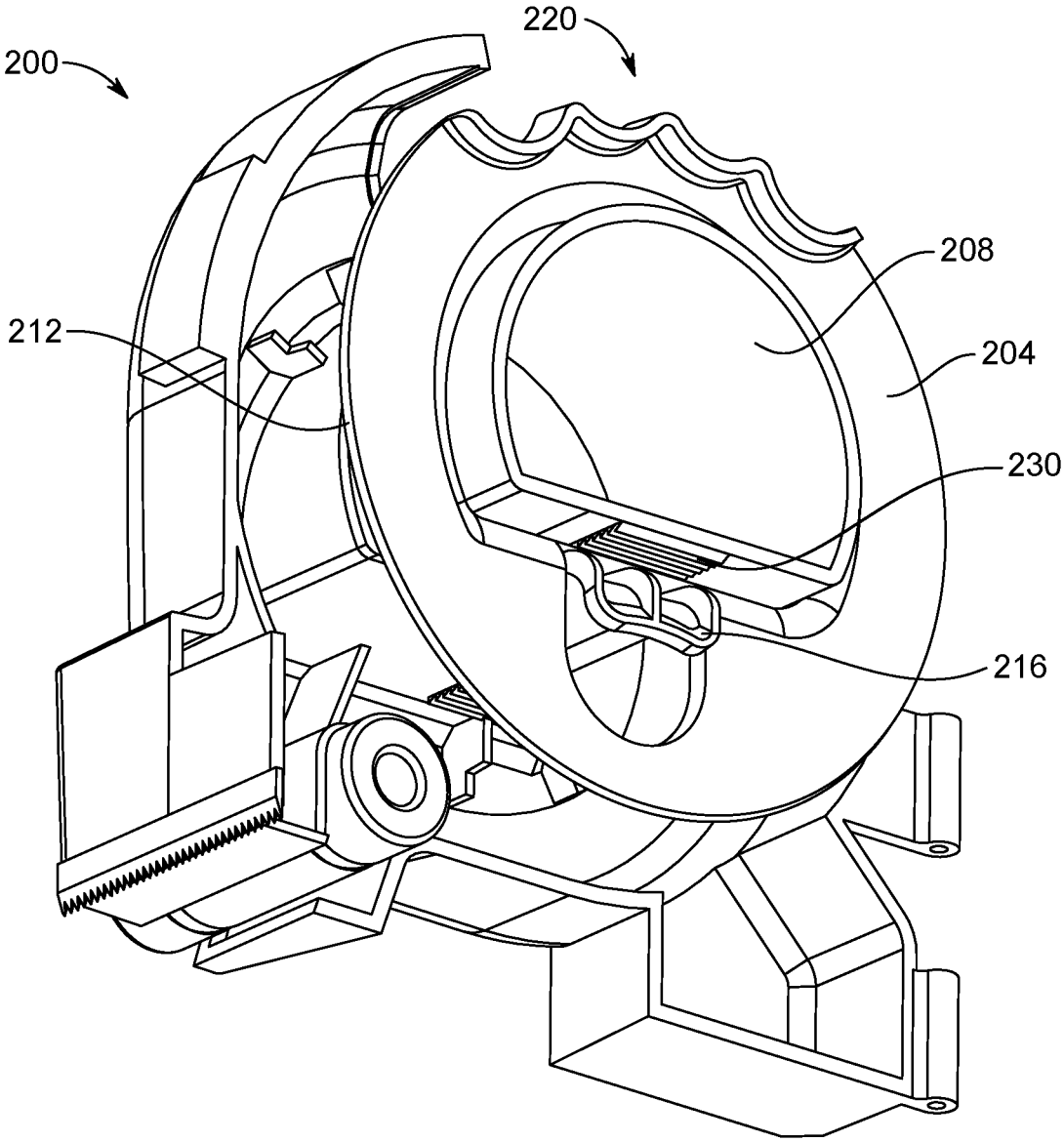
FIG. 13 is a perspective view of a tape applicator in an open position according to another embodiment of the disclosure.

FIG. 13 illustrates another embodiment of a tape applicator 200. The tape applicator 200 of FIG. 13 is similar to the tape applicator 10 of FIG. 1 and similar components are labeled with the same reference numerals. Only the differences between the tape applicator 200 of FIG. 13 and the tape applicator 10 of FIG. 1 are described herein.

Figure 14:
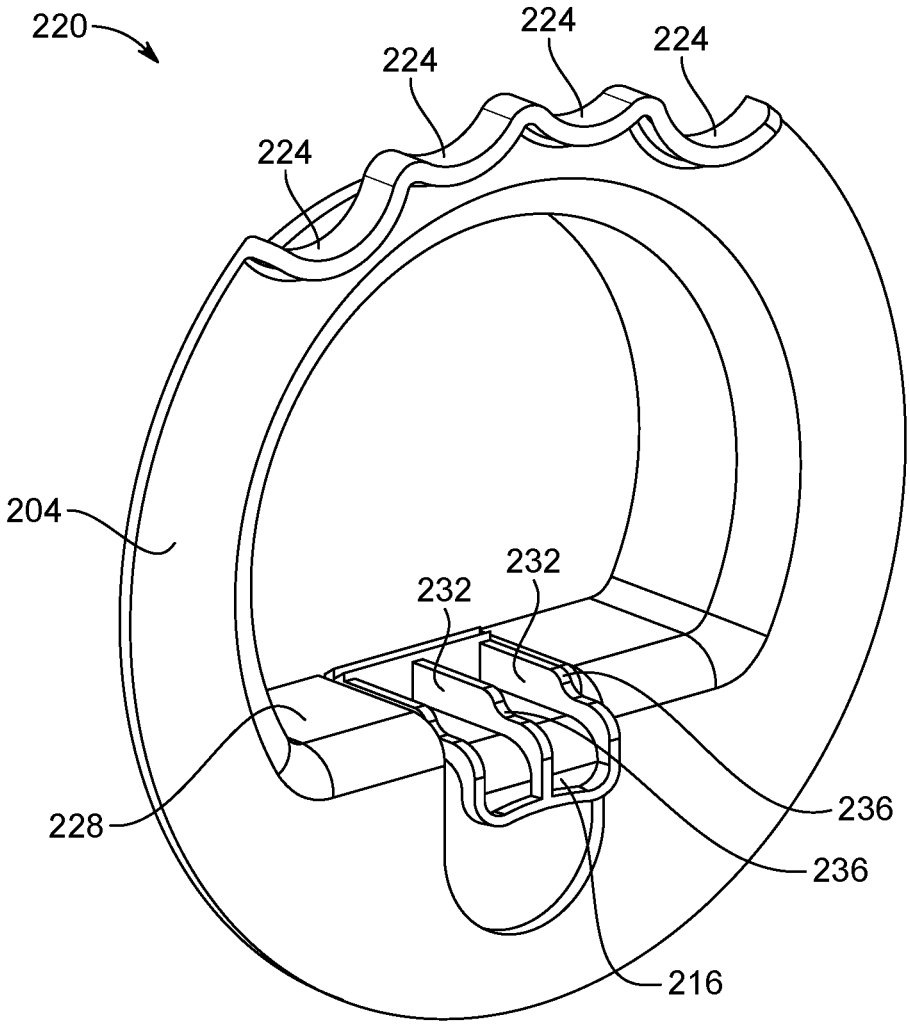
FIG. 14 is a perspective view of an adjustment plate for the tape applicator of FIG. 13.

As illustrated in FIG. 13, the tape applicator 200 includes an adjustment plate 204 that may be selectively mounted on a tape hub 208 for the tape applicator 200. The tape hub 208 is the same as the tape hub 54. As illustrated in FIG. 14, the adjustment plate 204 includes an outer periphery 212 and a tab 216. The outer periphery 212 includes an ergonomic grip 220 with grooves 224 that may be shaped to receive fingers of a user. As shown, the ergonomic grip 220 includes four grooves 224. The tab 216 is positioned on a planar section 228 of the adjustment plate 204. The tab 216 is similar to the tab 138 and may be actuated or manipulated to selectively engage teeth 230 on the tape hub 208 to secure the adjustment plate 204 at a desired position along the tape hub 208 (e.g., based on the width of the selected tape roll 14). The tab 216 includes a plurality of protrusions 232 having curved edges 236 that may engage the teeth 230 on the tape hub 208 to secure the adjustment plate 204 at a desired position relative to the tape hub 208. Specifically, the tab 216 includes three protrusions 232.

As described above, some or all illustrated features may be omitted in a particular implementation within the scope of the present disclosure, and some illustrated features may not be required for implementation of all embodiments. The features described above may be implemented in an order different from the order described above and does not prohibit implementation in another order or combination. While not explained in detail for each embodiment and/or construction, the features of the disclosure described herein may be included on a tape dispenser independent of other features and are not limited to the illustrated disclosure. Embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described with reference to certain embodiments, variations and modifications exist within the scope and spirit of one or more independent aspects of the invention as described. Various features of the invention are set forth in the following claims.

The invention claimed is:

1. A tape applicator comprising:

a housing including a first housing part defining a tape hub having a stepped rail, the stepped rail including a first tooth and a second tooth, a second housing part pivotably coupled to the first housing part so as to be rotatable between a closed position forming a closed housing with the first housing part and an open position to permit access to an interior of the housing;

an adjustment plate disposed between the first housing part and the second housing part, the adjustment plate including a tab actuatable to the first tooth or the second tooth when the second housing part of the housing is in the open position.

2. The tape applicator of claim 1, wherein the first housing part includes an internal wall, the tape hub extending from the internal wall, and wherein the adjustment plate is configured hold a first tape roll against the internal wall when the tab is engaged with the first tooth.

3. The tape applicator of claim 2, wherein the tab is actuatable to disengage from the first tooth or the second tooth, wherein the adjustment plate is movable between the first tooth and the second tooth, and wherein the tab is further actuatable to engage the other of the first tooth and the second tooth.

4. The tape applicator of claim 3, wherein when the tab is engaged with the second tooth, the adjustment plate is configured to hold a second tape roll against the internal wall, and wherein the second tape roll has a different width than the first tape roll.

5. The tape applicator of claim 1, further comprising an actuator disposed between the first housing part and the second housing part, the actuator being slidable to selectively lock the second housing part of the housing in the closed position, and wherein the actuator and the adjustment plate are formed as separate components that are independently operable from each other.

6. The tape applicator of claim 1, wherein the adjustment plate includes a central aperture that is shaped to fit around the tape hub.

7. The tape applicator of claim 1, wherein the tape hub has a substantially circular cross-section and includes a planar surface at one side of the substantially circular cross-section, and wherein the stepped rail is formed on the planar surface of the tape hub.

8. A tape applicator comprising:

a housing defining a cavity and including a first internal wall, a second internal wall, and a tape hub disposed in the cavity and extending away from the first internal wall, the cavity having a total volume; and an adjustment plate disposed in the cavity and mountable to the tape hub, wherein the first internal wall and the adjustment plate define a first volume of the cavity in which a tape roll can be placed, wherein the cavity has a second volume defined between the adjustment plate and the second internal wall such that the first volume and the second volume define the total volume of the cavity, and wherein movement of the adjustment plate along the tape hub changes the first volume while the total volume of the cavity remains the same.

9. The tape applicator of claim 8, wherein the housing includes a first housing part and a second housing part, wherein the second housing part is rotatable relative to the first housing part to open and close the tape applicator, and wherein the adjustment plate is formed separately from the first housing part and the second housing part.

* * * * *